US010405106B2

(12) United States Patent
Lee

(10) Patent No.: US 10,405,106 B2
(45) Date of Patent: Sep. 3, 2019

(54) DIFFERENTIAL MEMS MICROPHONE

(71) Applicant: Knowles Electronics, LLC, Itasca, IL (US)

(72) Inventor: Sung Lee, Chicago, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 15/775,371

(22) PCT Filed: Nov. 14, 2016

(86) PCT No.: PCT/US2016/061902
§ 371 (c)(1),
(2) Date: May 10, 2018

(87) PCT Pub. No.: WO2017/087332
PCT Pub. Date: May 26, 2017

(65) Prior Publication Data

US 2018/0270587 A1 Sep. 20, 2018

Related U.S. Application Data

(60) Provisional application No. 62/257,483, filed on Nov. 19, 2015.

(51) Int. Cl.
*H04R 19/00* (2006.01)
*H04R 19/04* (2006.01)
(Continued)

(52) U.S. Cl.
CPC ..... *H04R 19/04* (2013.01); *H04R 1/28* (2013.01); *H04R 3/005* (2013.01); *H04R 19/005* (2013.01); *H04R 2201/003* (2013.01)

(58) Field of Classification Search
CPC .... H04R 2201/003; H04R 19/04; H04R 1/28; H04R 3/005
See application file for complete search history.

(56) References Cited

U.S. PATENT DOCUMENTS 7,190,038 B2 3/2007 Dehe et al.
7,473,572 B2 1/2009 Dehe et al.
(Continued)

FOREIGN PATENT DOCUMENTS

CN 102726065 A 10/2012
CN 104902414 A 9/2015
(Continued)

OTHER PUBLICATIONS

International Search Report and Written Opinion, PCT/US2016/061902, Knowles Electronics, LLC, 7 pages (dated Jan. 19, 2017).

*Primary Examiner* — Sunita Joshi
(74) *Attorney, Agent, or Firm* — Foley & Lardner LLP

(57) ABSTRACT

A microphone includes a base; a first micro electro mechanical system (MEMS) device and a second MEMS device disposed on the base. The first MEMS device has a first diaphragm and a first back plate, and the second MEMS device has a second diaphragm and a second back plate. The first MEMS device and the second MEMS device are arranged such that positive pressure moves the first diaphragm towards the first back plate, and the positive pressure simultaneously moves the second diaphragm of the from second back plate.

20 Claims, 3 Drawing Sheets

(51) Int. Cl.
*H04R 3/00* (2006.01)
*H04R 1/28* (2006.01)

(56) References Cited

U.S. PATENT DOCUMENTS

| | | | |
|---|---|---|---|
| 7,781,249 | B2 | 8/2010 | Laming et al. |
| 7,795,695 | B2 | 9/2010 | Weigold et al. |
| 7,825,484 | B2 | 11/2010 | Martin et al. |
| 7,829,961 | B2 | 11/2010 | Hsiao |
| 7,856,804 | B2 | 12/2010 | Laming et al. |
| 7,903,831 | B2 | 3/2011 | Song |
| 8,582,788 | B2 | 11/2013 | Leidl et al. |
| 2005/0207605 | A1 | 9/2005 | Dehe et al. |
| 2007/0278501 | A1 | 12/2007 | MacPherson et al. |
| 2008/0175425 | A1 | 7/2008 | Roberts et al. |
| 2008/0267431 | A1 | 10/2008 | Leidl et al. |
| 2008/0279407 | A1 | 11/2008 | Pahl |
| 2008/0283942 | A1 | 11/2008 | Huang et al. |
| 2009/0001553 | A1 | 1/2009 | Pahl et al. |
| 2009/0116669 | A1 | 5/2009 | Song |
| 2009/0180655 | A1 | 7/2009 | Tien et al. |
| 2010/0046780 | A1 | 2/2010 | Song |
| 2010/0052082 | A1 | 3/2010 | Lee et al. |
| 2010/0128914 | A1 | 5/2010 | Khenkin |
| 2010/0183181 | A1 | 7/2010 | Wang |
| 2010/0246877 | A1 | 9/2010 | Wang et al. |
| 2010/0290644 | A1 | 11/2010 | Wu et al. |
| 2010/0322443 | A1 | 12/2010 | Wu et al. |
| 2010/0322451 | A1 | 12/2010 | Wu et al. |
| 2011/0013787 | A1 | 1/2011 | Chang |
| 2011/0075875 | A1 | 3/2011 | Wu et al. |
| 2011/0158449 | A1 | 6/2011 | Tanaka et al. |
| 2011/0248364 | A1 | 10/2011 | Huang et al. |
| 2012/0300969 | A1* | 11/2012 | Tanaka ..... H04R 19/005 381/355 |
| 2013/0044899 | A1 | 2/2013 | Barber et al. |
| 2013/0108074 | A1* | 5/2013 | Reining ..... H04R 3/005 381/92 |
| 2014/0008740 | A1 | 1/2014 | Wang et al. |
| 2015/0296307 | A1 | 10/2015 | Shao et al. |
| 2016/0165357 | A1* | 6/2016 | Morishita ..... H04R 19/005 381/170 |
| 2018/0041840 | A1 | 2/2018 | Zheng |
| 2018/0041842 | A1 | 2/2018 | Zheng |

FOREIGN PATENT DOCUMENTS

| | | | |
|---|---|---|---|
| CN | 104902415 | A | 9/2015 |
| WO | WO-2015/142893 | A1 | 9/2015 |

* cited by examiner

DIFFERENTIAL MEMS MICROPHONE

CROSS-REFERENCE TO RELATED APPLICATIONS

This application is a National Stage Application of PCT/US2016/061902, filed Nov. 14, 2016, which claims the benefit of and priority to U.S. Provisional Patent Application No. 62/257,483, filed Nov. 19, 2015, the entire contents of which are incorporated herein by reference.

TECHNICAL FIELD

This application relates to microphones, and more specifically, differential microphones.

BACKGROUND OF THE INVENTION

Different types of acoustic devices have been used through the years. One type of device is a microphone. In a microelectromechanical system (MEMS) microphone, a MEMS die includes a diagram and a back plate. The MEMS die is supported by a substrate and enclosed by a housing (e.g., a cup or cover with walls). A port may extend through the substrate (for a bottom port device) or through the top of the housing (for a top port device). In any case, sound energy traverses through the port, moves the diaphragm and creates a changing potential of the back plate, which creates an electrical signal. Microphones are deployed in various types of devices such as personal computers and cellular phones.

Various types of problems can arise as microphones are operated. Total harmonic distortion (THD) can be thought of as the level of distortion or nonlinearity of output signals. Output signal can be considered linear if the input signal can be represented by using the output signal by multiplying the output signal with a constant value. More specifically, THD can be defined as the ratio of the sum of the powers of all harmonic components of a signal to the power of the fundamental frequency of the output signal. The less the THD, the better the signal quality of the microphone.

Previous approaches have not always proven satisfactory for reducing THD and this has resulted in some user dissatisfaction with these previous approaches.

SUMMARY

In general, one aspect of the subject matter described in this specification can be embodied in a microphone. The microphone comprises a base, a first micro electro mechanical system (MEMS) device disposed on the base, and a second MEMS device disposed on the base. The first MEMS device includes a first diaphragm and a first back plate. The second MEMS device includes a second diaphragm and a second back plate. The first MEMS device and the second MEMS device are arranged such that positive pressure moves the first diaphragm towards the first back plate, and the positive pressure simultaneously moves the second diaphragm of the from second back plate.

Another aspect of the subject matter can be embodied in a microphone. The microphone comprises a base, a first micro electro mechanical system (MEMS) device disposed on the base, and a second MEMS device disposed on the base. The first MEMS device comprises a first diaphragm, a first back plate, and a first substrate supporting the first diaphragm and the first back plate. The first diaphragm is between the first back plate and the base. The second MEMS comprises a second diaphragm, a second back plate, and a second substrate supporting the second diaphragm and the second back plate. The second back plate is between the second diaphragm and the base.

Yet another aspect of the subject matter can be embodied in a microphone. The microphone comprises a base, a substrate disposed on the base, a first MEMS device and a second MEMS device supported by the substrate. The first MEMS device comprises a first diaphragm and a first back plate. The first diaphragm is between the first back plate and the base. The second MEMS device comprises a second diaphragm, and a second back plate. The second back plate is between the second diaphragm and the base.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1:
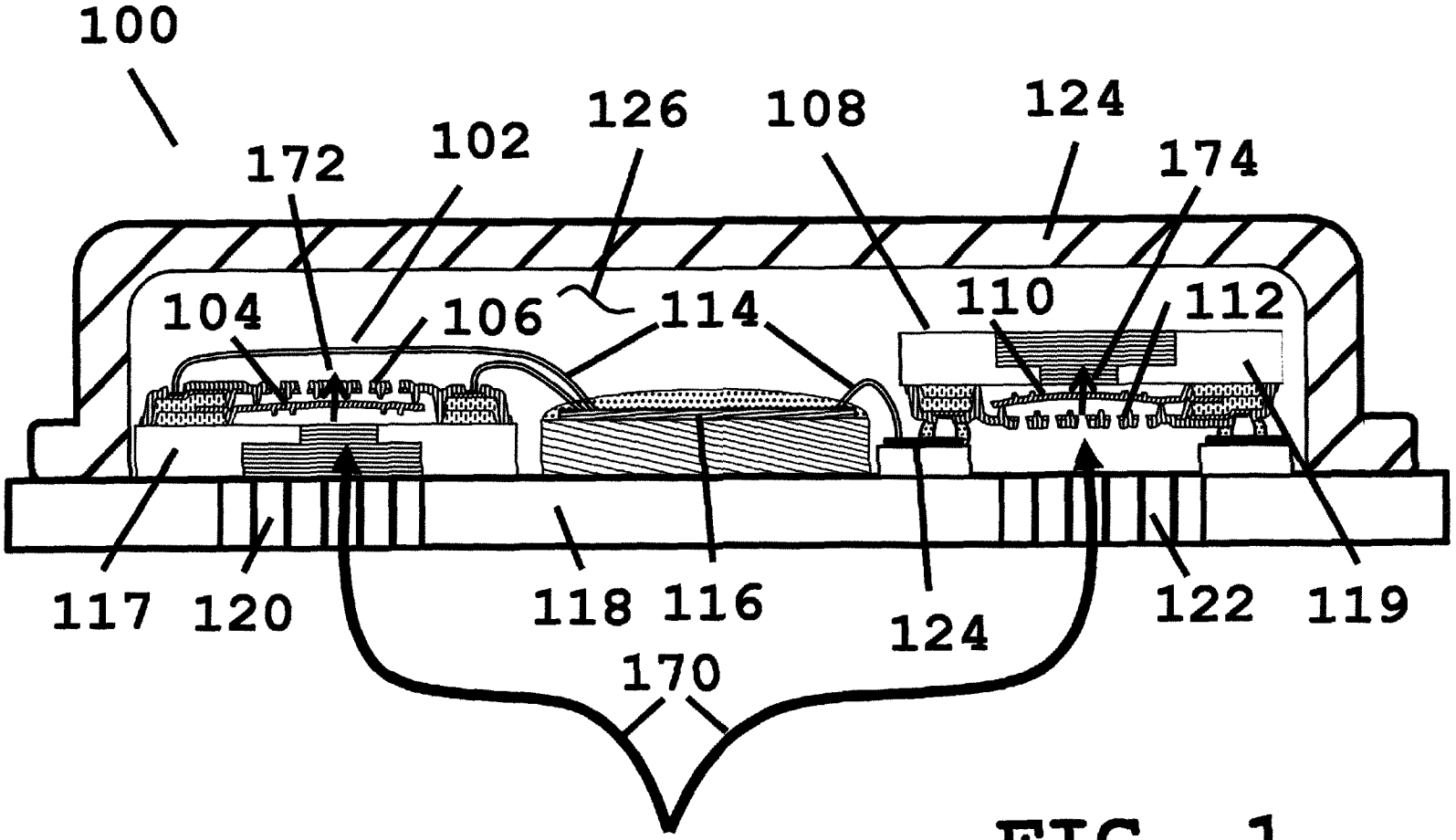
FIG. 1 comprises a side cutaway view of dual MEMS differential microphone according to various embodiments of the present invention.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

The present approaches provide differential microphones with improved performance characteristics. In aspects, two micro electro mechanical system (MEMS) devices (or motors) are provided. A first MEMS device includes a first diaphragm and a first back plate, and a second MEMS device includes a second diaphragm and a second back plate. Positive pressure moves the first diaphragm closer to the first back plate. This positive pressure simultaneously moves the second diaphragm further away from the second back plate.

In so doing, total harmonic distortion is significantly reduced and the performance of the microphone is improved.

Referring now to FIG. 1, one example of a microphone 100 is described. A first MEMS device 102 includes a first diaphragm 104 and a first back plate 106, and a second MEMS device 108 includes a second diaphragm 110 and a second back plate 112. Lead wires 114 couple the first MEMS device 102 and second MEMS device 108 to an integrated circuit 116 (e.g., an application specific integrated circuit). Each of the MEMS devices 102 or 108 also includes a MEMS substrate 117, 119, which separately supports or holds the diaphragms and back plates. The substrates 117 and 119 may be constructed of silicon.

The first MEMS device 102, the second MEMS device 108, and the integrated circuit 116 are disposed on a base or substrate 118. In one example, the base 118 may be a printed circuit board. Other examples are possible. A first port 120 and second port 122 extend through the base 118 and allow sound pressure to reach the first MEMS 102 and the second MEMS 108. A cover 124 couples to the base 118 and encloses the MEMS devices 102, 108 and integrated circuit 116 creating a back volume 126. The cover 124 may be constructed of any conducting material such as copper, nickel, or gold or layers of conducting materials.

In this example, the second MEMS device 108 is flip chip connected to the base 118 and the base contain conducting traces, 124, that electrically connects to the MEMS and allow lead wire, 114, attachment and connection to the ASIC, 116. As connected the diaphragms and back plates of the first and second MEMS devices are disposed in reverse order, i.e., the diaphragm of one is on the top relative to the back plate, and the diaphragm of the other is on the bottom relative to its back plate.

It will be appreciated that the back plates and diaphragms of each of the MEMS devices in the absence of sound pressure are the same or approximately the same distance apart. In operation, positive sound pressure 170 moves the first diaphragm 104 closer to the first back plate 106 (relative to the starting position) as indicated by the arrow labeled 172. This positive pressure 170 simultaneously moves the second diaphragm 110 further away from the second back plate 112 (relative to the starting position) as indicated by the arrow labeled 174. In so doing, total harmonic distortion is reduced and the performance of the microphone is improved.

The signals from the two MEMS devices are obtained and the difference is taken from each signal and produces a sinusoidal or near sinusoidal signal with significantly reduced THD. In this example, this may occur at the integrated circuit 116, but it will also be appreciated the difference can be obtained by routing the signals to outside the microphone and the difference obtained by an external circuit.

Figure 2:
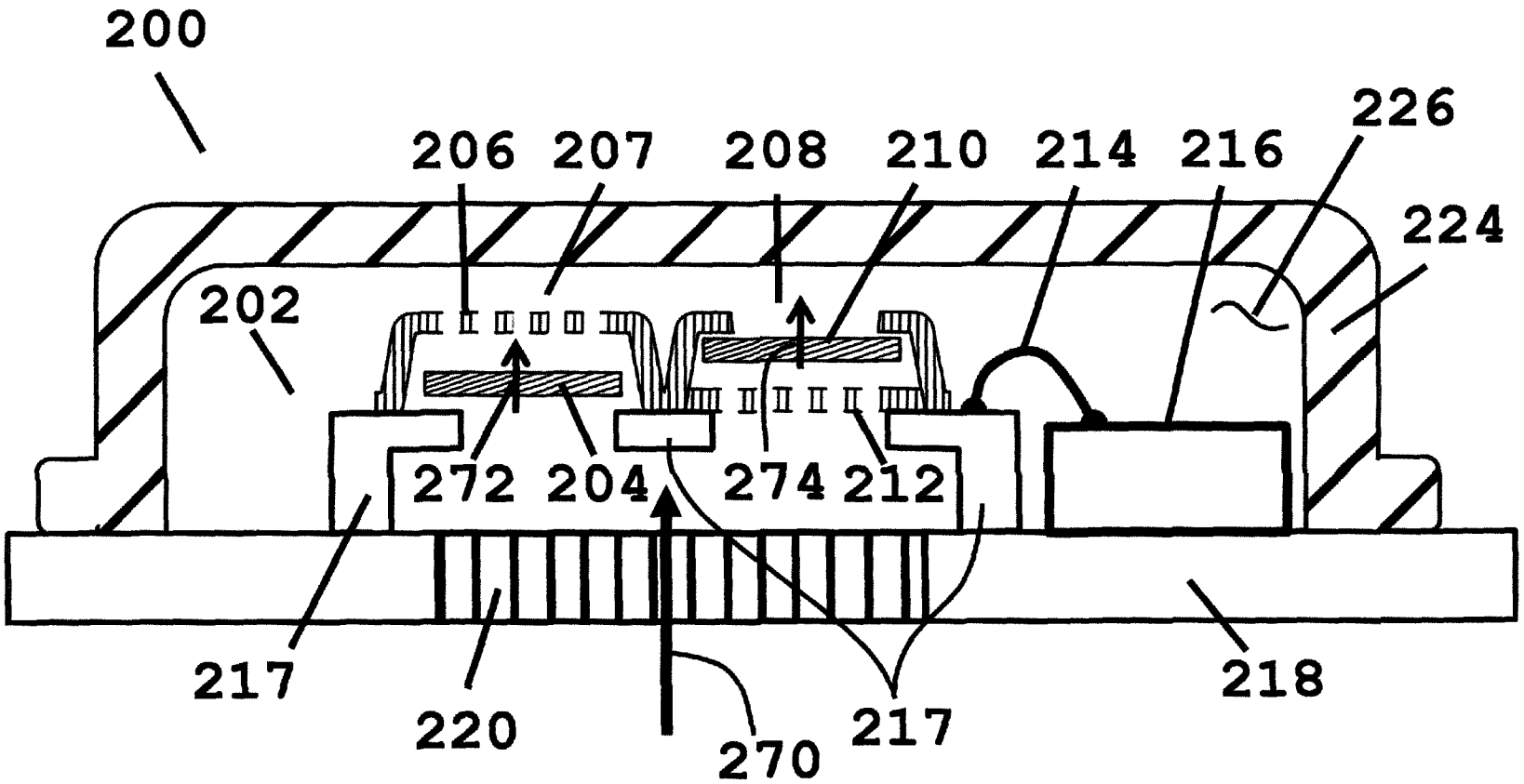
FIG. 2 comprises a block diagram of another example of a dual MEMS differential microphone according to various embodiments of the present invention.

Referring now to FIG. 2, another example of a microphone 200 is described. A first MEMS device 202 includes a first diaphragm 204 and a first back plate 206 together forming the first motor 207, and a second motor 208 which includes a second diaphragm 210 and a second back plate 212. Lead wires 214 couple the first motor 207 and second motor 208 to an integrated circuit 216 (e.g., an application specific integrated circuit). The MEMS device 202 also include a common MEMS substrate 217, which supports or holds the diaphragms and back plates. The common substrate 217 may be constructed of silicon.

The MEMS device 202 and the integrated circuit 216 are disposed on a base or substrate 218. In one example, the base 218 may be a printed circuit board. Other examples are possible. A port 220 extends through the base 218 and allows sound pressure to reach the MEMS 202 and its two motors, 207 and 208. A cover 224 couples to the base 218 and encloses the MEMS device 202 and integrated circuit 216 creating a back volume 226. The cover 224 may be constructed of any conducting material such as copper, nickel, or gold or layers of conducting materials.

It will be appreciated that the back plates and diaphragms of each of the MEMS devices in the absence of sound pressure are the same or approximately the same distance apart. In operation, positive sound pressure 270 moves the first diaphragm 204 closer to the first back plate 206 as indicated by the arrow labeled 272. This positive pressure 270 simultaneously moves the second diaphragm 210 further away from the second back plate 212 as indicated by the arrow labeled 274. In so doing, total harmonic distortion is reduced and the performance of the microphone is improved.

The signals from the two MEMS devices are obtained and the difference is taken from each signal and produces a sinusoidal or near sinusoidal signal with significantly reduced THD. In this example, this may occur at the integrated circuit 216, but it will also be appreciated the difference can be obtained by routing the signals to outside the microphone and the difference obtained by an external circuit.

Figure 3:
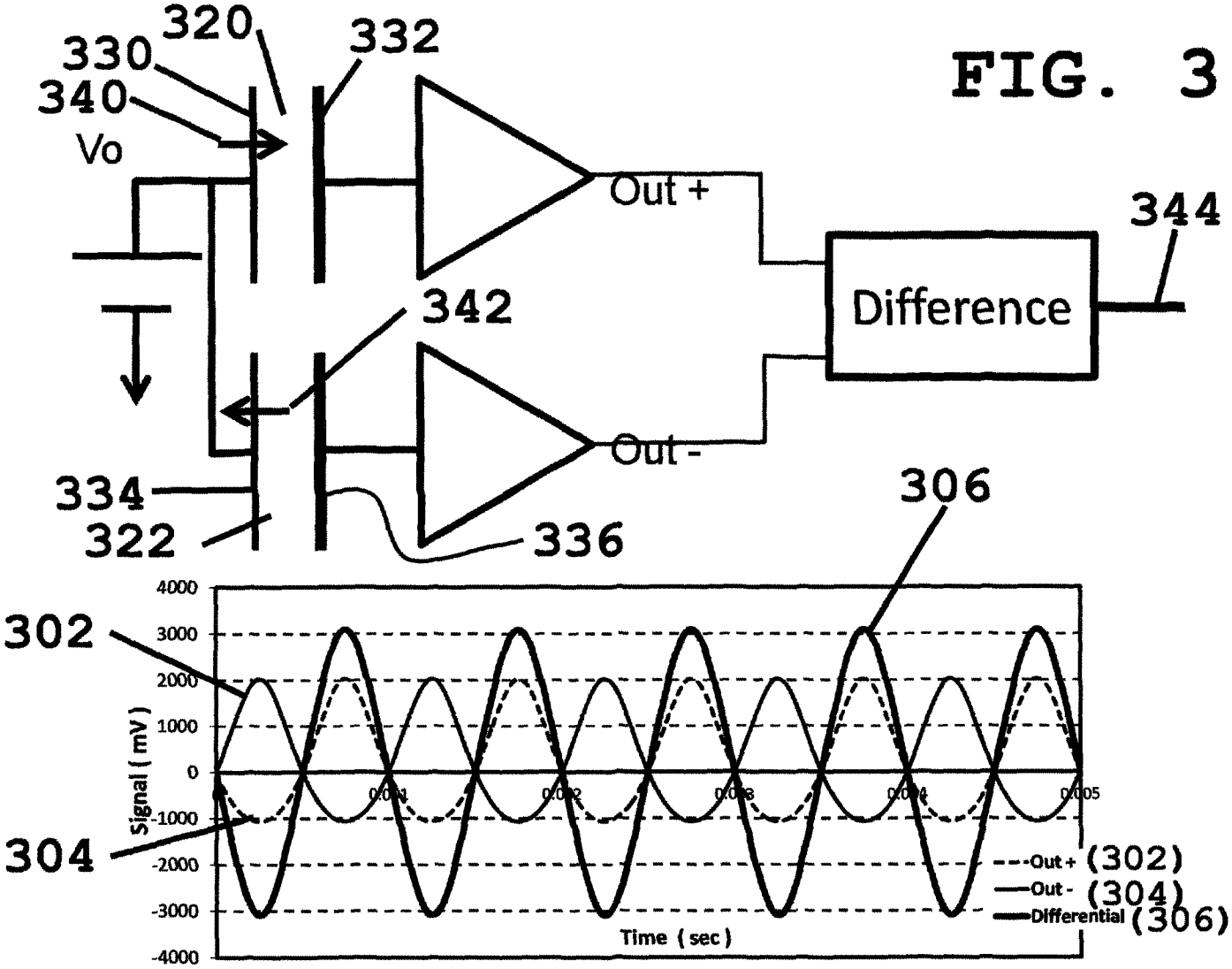
FIG. 3 comprises a block diagram of a graph of some of the advantages of the dual MEMS differential microphones according to various embodiments of the present invention.

Referring now to FIG. 3, one example of some of the advantages of the present approaches is described. This is a dual microphone with two MEMS motors or devices 320 and 322. Positive pressure moves one diaphragm 330 towards its back plate 332 in the direction indicated by the arrow labeled 340, while simultaneously and the same positive pressure moves the second diaphragm 334 away from its back plate 336 in the direction indicated by arrow 342. The MEMS device or devices are biased by voltage Vo.

Using the approaches described herein, a first curve 302 is produced by a first MEMS device (positive pressure moves the diaphragm of this MEMS or motor towards its back plate), and the second curve 304 is produced by the second MEMS device (positive pressure moves the diaphragm of this MEMS or motor away from its back plate). The difference 344 is obtained by taking the outputs (after being amplified) and this produces the waveform 306. It will be appreciated that the difference obtained is a nearly sinusoidal signal back (the input signal, i.e. the sound pressure, was sinusoidal). Non-linearities are cancelled or substantially eliminated.

It will be appreciated that any of the above examples produces these results or similar results as shown in FIG. 3.

The herein described subject matter sometimes illustrates different components contained within, or connected with, different other components. It is to be understood that such depicted architectures are merely exemplary, and that in fact many other architectures can be implemented which achieve the same functionality.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A microphone, comprising:

a base;

a first micro electro mechanical system (MEMS) device disposed over a first portion of the base, the first MEMS device having a first diaphragm and a first back plate;

a second MEMS device, the second MEMS device disposed over a second portion of the base different from the first portion, the second MEMS device having a second diaphragm and a second back plate;

wherein the first MEMS device and the second MEMS device are arranged such that positive pressure moves the first diaphragm towards the first back plate, and the positive pressure simultaneously moves the second diaphragm away from the second back plate.

2. The microphone of claim 1, wherein one of the first MEMS device and the second MEMS device is flip-chip connected to the base.

3. The microphone of claim 1, further comprising a port extending through the base.

4. The microphone of claim 1, further comprising a cover coupled to the base and enclosing the first MEMS device and the second MEMS device, and a port extending through the cover.

5. The microphone of claim 1, wherein the first MEMS device is disposed over a first port extending through the base and the second MEMS device is disposed over a second port extending through the base.

6. The microphone of claim 1, further comprising an integrated circuit disposed on the base.

7. The microphone of claim 1, wherein the first diaphragm and the first back plate are disposed on a first MEMS silicon base, and the second diaphragm and the second back plate are disposed on a second MEMS silicon base.

8. A microphone comprising:

a base;

a first micro electro mechanical system (MEMS) device disposed over a first portion of the base, the first MEMS device comprising:

a first diaphragm;

a first back plate; and a first substrate supporting the first diaphragm and the first back plate, wherein the first diaphragm is positioned between the first back plate and the base, and a second MEMS device disposed over a second portion of the base different from the first portion, the second MEMS device comprising:

a second diaphragm;

a second back plate; and a second substrate supporting the second diaphragm and the second back plate, wherein the second back plate is positioned between the second diaphragm and the base.

9. The microphone of claim 8, wherein the second MEMS device is flip-chip connected to the base.

10. The microphone of claim 8, further comprising an integrated circuit disposed on the base.

11. The microphone of claim 10, wherein the first MEMS device and the second MEMS device are connected to the integrated circuit through lead wires.

12. The microphone of claim 11, wherein the integrated circuit is configured to generate an output of the microphone using a difference between signals from the first MEMS device and the second MEMS device.

13. The microphone of claim 8, wherein the base includes a printed circuit board.

14. The microphone of claim 8, wherein the first substrate and the second substrate are constructed of silicon.

15. A microphone comprising:

a base;

a substrate disposed on the base, the substrate holding a first MEMS device positioned over a first portion of the base and a second MEMS device positioned over a second portion of the base, the second portion different from the first portion;

the first MEMS device comprising:

a first diaphragm; and a first back plate;

wherein the first diaphragm is positioned between the first back plate and the base; and the second MEMS device comprising:

a second diaphragm; and a second back plate;

wherein the second back plate is positioned between the second diaphragm and the base.

16. The microphone of claim 15, wherein the base includes a printed circuit board, and wherein the substrate is constructed of silicon.

17. The microphone of claim 15, further comprising an integrated circuit disposed on the base.

18. The microphone of claim 15, wherein the first MEMS device and the second MEMS device are connected to the integrated circuit through lead wires.

19. The microphone of claim 18, wherein the integrated circuit is configured to generate an output of the microphone using a difference of signals from the first MEMS device and the second MEMS device.

20. The microphone of claim 15, further comprising a port extending through the base, which allows sound pressure to reach the first MEMS device and the second MEMS device.

* * * * *